US010631694B2

(12) United States Patent
Kim et al.

(10) Patent No.: US 10,631,694 B2
(45) Date of Patent: Apr. 28, 2020

(54) AUTONOMOUS CLEANER

(71) Applicant: LG ELECTRONICS INC., Seoul (KR)

(72) Inventors: Hwang Kim, Seoul (KR); Sungil Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 255 days.

(21) Appl. No.: 15/819,232

(22) Filed: Nov. 21, 2017

(65) Prior Publication Data

US 2019/0008344 A1 Jan. 10, 2019

(30) Foreign Application Priority Data

Jul. 6, 2017 (KR) ..... 10-2017-0086098

(51) Int. Cl.
*A47L 9/00* (2006.01)
*A47L 9/28* (2006.01)
(Continued)

(52) U.S. Cl.
CPC ..... *A47L 9/009* (2013.01); *A47L 9/0686* (2013.01); *A47L 9/1409* (2013.01);
(Continued)

(58) Field of Classification Search
CPC ..... A47L 9/009; A47L 9/0686; A47L 9/1409; A47L 9/2826; A47L 9/2852; A47L 2201/04
(Continued)

(56) References Cited

U.S. PATENT DOCUMENTS 7,213,663 B2 5/2007 Kim
9,943,203 B2 * 4/2018 Samuels ..... A47L 9/2889
2018/0344118 A1 * 12/2018 Kim ..... A47L 9/009

FOREIGN PATENT DOCUMENTS

CN 1575721 2/2005
CN 102987987 3/2013
(Continued)

OTHER PUBLICATIONS

PCT International Search Report (Full English Text) dated Apr. 3, 2018 issued in International Application No. PCT/KR2017/013949.
(Continued)

*Primary Examiner* — David Redding
(74) *Attorney, Agent, or Firm* — KED & Associates, LLP

(57) ABSTRACT

An autonomous cleaner includes: a cleaner body; a cleaning module protruded from one side of the cleaner body, and having a castor; caterpillar units provided at both sides of the cleaner body, and positioned at a rear side of the cleaning module, wherein the caterpillar unit includes: a driving module; a driving wheel mounted to the driving module, and formed to be rotatable by receiving a driving force from the driving module; a driven wheel mounted to the driving module, and provided at a rear side of the driving wheel; and a belt formed to entirely enclose the driving wheel and the driven wheel as a closed loop, and configured to rotate the driven wheel when the driving wheel is rotated. The cleaner body is supported on a floor surface by the castor and the driven wheel, or by the driving wheel and the driven wheel.

20 Claims, 15 Drawing Sheets

(51) Int. Cl.
*A47L 9/14* (2006.01)
*A47L 9/06* (2006.01)

(52) U.S. Cl.
CPC ..... *A47L 9/2826* (2013.01); *A47L 9/2852* (2013.01); *A47L 2201/04* (2013.01)

(58) Field of Classification Search
USPC ..... 15/319, 340.1, 340.3, 354
See application file for complete search history.

(56) References Cited

FOREIGN PATENT DOCUMENTS

| | | |
|---|---|---|
| CN | 204564688 | 8/2015 |
| CN | 105520691 | 4/2016 |
| EP | 2 891 440 | 7/2015 |
| JP | 2007-244722 | 9/2007 |
| KR | 10-2005-0003112 | 1/2005 |
| KR | 10-0779195 | 11/2007 |
| KR | 10-2013-0004825 | 1/2013 |
| KR | 10-2013-0035389 | 4/2013 |
| KR | 10-1571381 | 12/2015 |
| KR | 10-2016-0121844 | 10/2016 |
| KR | 10-2016-0138812 | 12/2016 |

OTHER PUBLICATIONS

Taiwanese Office Action (with English translation) dated Apr. 8, 2019 issued in TW Application No. 106140163.
Korean Notice of Allowance dated Jun. 25, 2019 issued in Application No. 10-2017-0086098.

* cited by examiner

AUTONOMOUS CLEANER

CROSS-REFERENCE TO RELATED APPLICATION

This application claims priority under 35 U.S.C. § 119 to Korean Application No. 10-2017-0086098, filed on Jul. 6, 2017, whose entire disclosure is hereby incorporated by reference.

BACKGROUND

1. Field

This specification relates to an autonomous cleaner having caterpillar units (or continuous track units) for moving a cleaner body.

2. Background

A cleaner is an apparatus for performing a cleaning function by sucking dust or foreign materials or through a mopping operation. Generally, the cleaner performs a cleaning function with respect to a floor, and includes wheels for movement. Generally, the wheels are moved by an external force applied to the cleaner body, and are configured to move the cleaner body on a floor.

However, recently, research on an autonomous cleaner such as a robot cleaner which performs a cleaning function while autonomously moving without a user's manipulation, and a cleaner which moves autonomously along a nozzle moved according to a user's manipulation, is actively ongoing.

Such an autonomous cleaner is generally provided with a driving wheel rotated by receiving a driving force from a driving motor. However, a belt driving type caterpillar (also known as a continuous track) rather than the driving wheel has been introduced recently. The reason is because an ascending performance of the autonomous cleaner can be more enhanced by the caterpillar than the driving wheel, and a moving performance can be obtained even on a soft floor such as a carpet. However, it is difficult to maintain a moving performance of the autonomous cleaner at a floor environment which changes every moment. Thus, one of researchers' tasks is to develop a design for stably obtaining a moving performance.

In order to stably obtain a moving performance, a cleaner body should be stably supported on a floor surface, firstly (first condition). Secondly, the caterpillar or the driving wheel should maintain a contacted state to a floor, even if a state of a condition of the floor is changed (second condition). Thirdly, an impact generated while the autonomous cleaner is moving should be attenuated (third condition).

FIGS. 1A, 1B, 2A and 2B are views showing a robot cleaner (or an autonomous cleaner) to which a caterpillar device shown in patent documents has been applied. With regards to the first condition, Korean Laid-Open Patent Publication No. 10-2016-0138812 (hereinafter, will be referred to as patent document 1) discloses an auxiliary wheel 15" and a caterpillar type main wheel 15' (as shown in FIGS. 1A and 1B). And European Laid-Open Patent Publication No. 2891440 (hereinafter, will be referred to as patent document 2) discloses a plurality of rollers 31 and a caterpillar type traction unit 20 (as shown in FIGS. 2A and 2B).

However, in the above structure, caterpillars are provided on right and lefts sides of a cleaner body, and a belt of the caterpillars comes in linear-contact with a floor surface. Therefore, the cleaner body should be provided with a castor or wheel in order to maintain its horizontal state. If the castor is provided at the cleaner body, a moving resistance due to the castor is increased. This may lower a moving performance.

With regards to the second condition, the patent document 1 discloses a configuration that driven wheels 15*b*, 15*c* having a smaller diameter than a driving wheel 15*a* are provided at both sides of the driving wheel 15*a*, in an upward-spaced state from a floor surface (see FIGS. 1A and 1B). And the patent document 2 discloses a configuration that a driving wheel 94 having a smaller diameter than a driven wheel 96 is provided at a front upper side of the driven wheel 96 in a spaced manner (see FIGS. 2A and 2B).

In the above structure, when an inclination angle of the caterpillars with respect to the floor surface is large, an ascending performance (a climbing performance) of the robot cleaner (or the autonomous cleaner) is enhanced. However, in this case, a moving performance of the robot cleaner (or the autonomous cleaner) is lowered, because a contact area of the belt of the caterpillars with the floor surface is reduced when the robot cleaner moves on a soft floor (e.g., a carpet, a rug, etc.). Thus, it is difficult to maintain a moving performance of the autonomous cleaner at a floor environment which changes every moment.

With regards to the third condition, the patent document 2 discloses a swing arm 92 which elastically moves a driven wheel 96 clockwise or counterclockwise on the basis of a driving wheel 94. In the above structure, the driving wheel 94 is fixed to the cleaner body. Accordingly, if an impact is directly applied to the driving wheel 94, the impact may be transferred to the cleaner body.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Hereinafter, an autonomous cleaner according to the present disclosure will be explained in more detail with reference to the attached drawings.

Figure 1A:
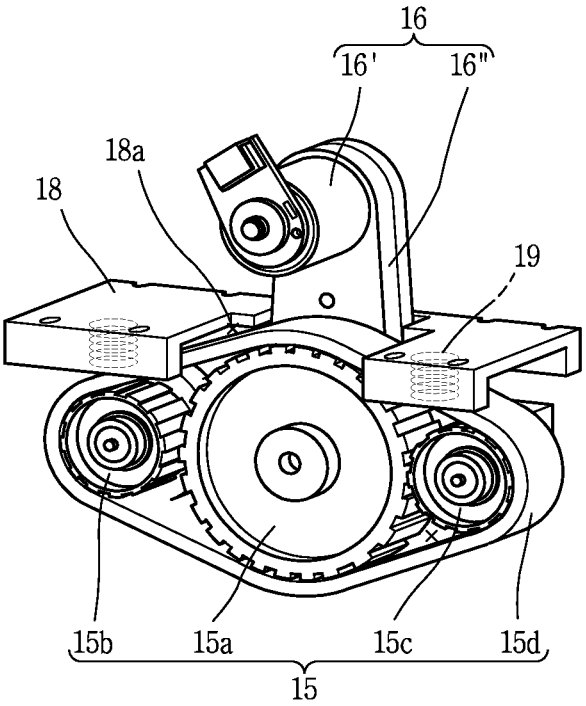
FIGS. 1A and 1B are views showing a robot cleaner to which a caterpillar device shown in patent document 1 has been applied.
Figure 1B:
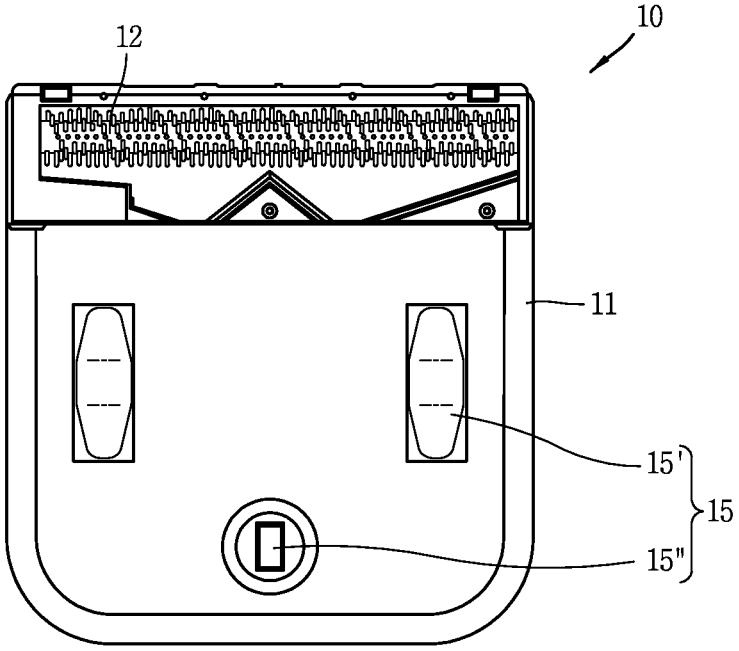
Figure 2A:
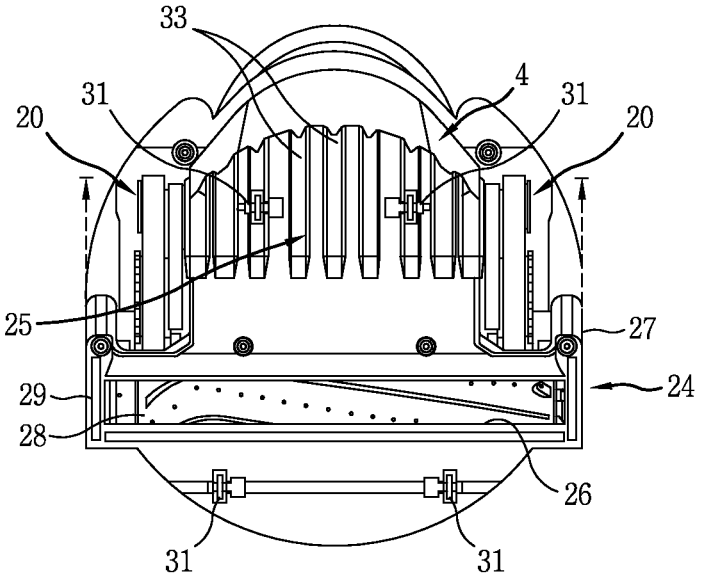
FIGS. 2A and 2B are views showing an autonomous cleaner to which a caterpillar device shown in patent document 2 has been applied.
Figure 2B:
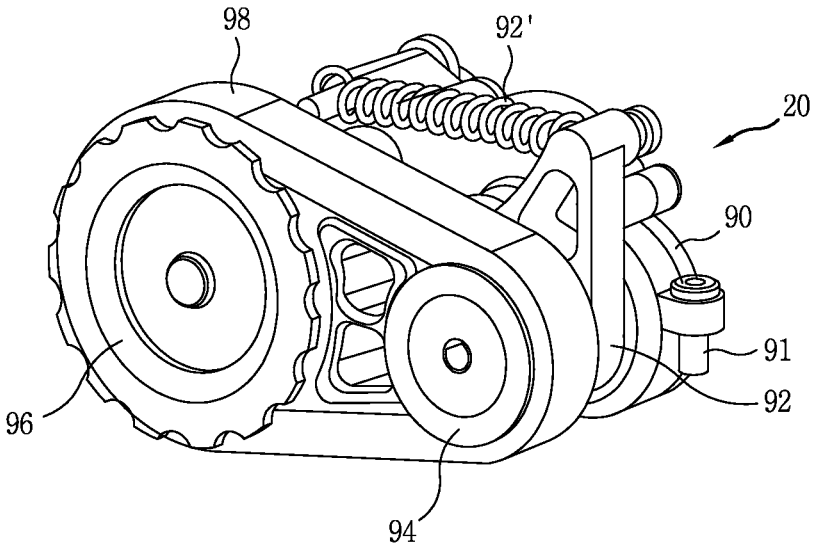
Figure 3:
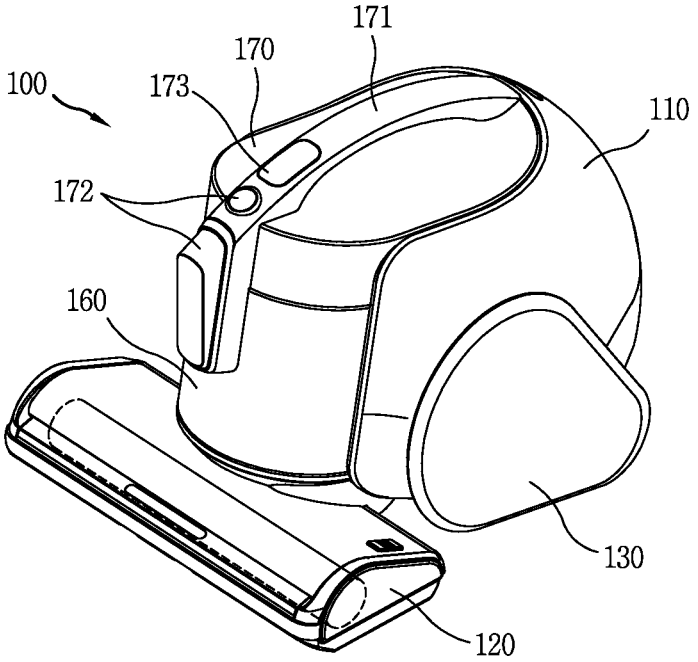
FIG. 3 is a perspective view showing an autonomous cleaner according to a first embodiment of the present disclosure.
Figure 4:
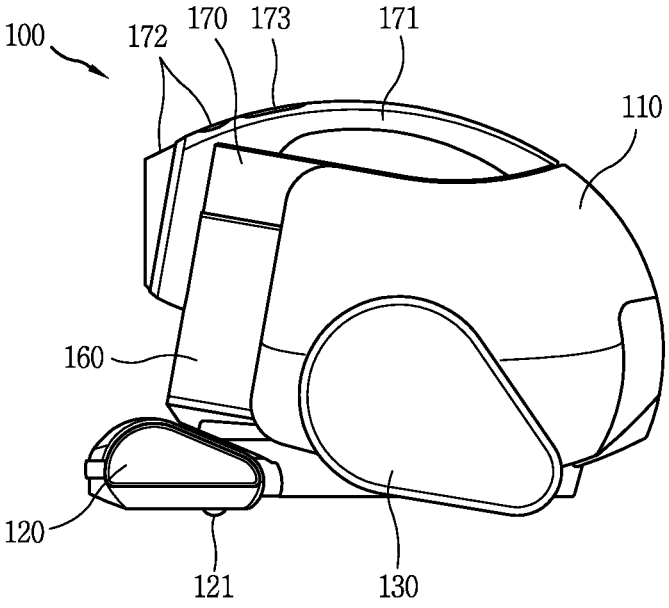
FIG. 4 is a side sectional view of the autonomous cleaner shown in FIG. 3.

FIG. 3 is a perspective view showing an autonomous cleaner 100 according to a first embodiment of the present disclosure, and FIG. 4 is a side sectional view of the autonomous cleaner 100 shown in FIG. 3. FIGS. 3 and 4 show a first embodiment of the autonomous cleaner 100 which performs a function to clean a floor while autonomously moving on a predetermined region. The function to clean a floor includes a function to suck dust on a floor, or a function to mop a floor.

The autonomous cleaner 100 includes a cleaner body 110, a cleaning module (or cleaning head) 120 and caterpillar units (or caterpillar tracks) 130. The cleaner body 110 forms an appearance of the autonomous cleaner 100. Various types of components including a controller (not shown) for controlling the autonomous cleaner 100 are mounted to the cleaner body 110.

A dust container 160 is detachably mounted to the cleaner body 110, and a dust container cover 170 for covering the dust container 160 is provided. In an embodiment, the dust container cover 170 may be hinge-coupled to the cleaner body 110 so as to be rotatable.

The dust container cover 170 may be fixed to the dust container 160 or the cleaner body 110 to cover an upper surface of the dust container 160. In the state that the dust container cover 170 is arranged to cover the upper surface of the dust container 160, the dust container 160 may be prevented from being separated from the cleaner body 110 due to the dust container cover 170.

The dust container cover 170 may be provided with a handle 171, and a button portion 173 may be provided at the handle 171. A user may rotate the dust container cover 170 by pressing the button portion 173 with holding the handle 171. As a result, the dust container 160 is in a separable state from the cleaner body 110.

A sensing unit (or sensor) 172 for sensing a peripheral situation may be provided at the cleaner body 110. The sensing unit 172 may include a sensor (not shown) for sensing an obstacle or a terrain feature, and the controller for generating a map of a driving region based on sensed data. In the drawings, the sensor of the sensing unit 172 is provided at a front side of the handle 171 so as to sense a front side and an upper side.

The cleaning module 120 is configured to suck dust-included air or to clean a floor. The cleaning module 120 for sucking dust-included air may be referred to as a suction module, and the cleaning module 120 for cleaning a floor may be referred to as a mop module.

The cleaning module 120 may be detachably coupled to the cleaner body 110. Once the suction module is separated from the cleaner body 110, a mop module may be detachably coupled to the cleaner body 110 by replacing the separated suction module. Accordingly, a user may mount a suction module to the cleaner body 110 in case of removing dust on a floor, and may mount a mop module to the cleaner body 110 in case of mopping a floor. The cleaning module 120 may be also configured to suck dust-included air, and then to mop a floor.

The cleaning module 120 is protruded from one side of the cleaner body 110. The one side may be a forward driving side of the cleaner body 110, i.e., a front side of the cleaner body 110.

In the drawings, the cleaning module 120 is protruded from one side of the cleaner body 110, towards a front side and right and left sides. More specifically, a front end of the cleaning module 120 is arranged at a position forward spaced apart from one side of the cleaner body 110. And right and left ends of the cleaning module 120 are arranged at positions spaced apart from one side of the cleaner body 110 right and left.

A castor (or wheel) 121 is provided at the cleaning module 120. The castor 121 is configured to assist a driving of the autonomous cleaner 100, and to support the autonomous cleaner 100 together with caterpillar units 130 to be explained later. A structure to support the autonomous cleaner 100 by the caterpillar units 130 and the castor 121 will be explained later in more detail.

The cleaner body 110 is provided with the caterpillar units 130. The caterpillar units 130 are formed to be rotatable by receiving a driving force from driving motors 134*a* (see FIG. 8). A driving direction of the driving motor 134*a* may be controlled by the controller, and the caterpillar units 130 may be rotatable in one direction or another direction.

The caterpillar units 130 may be provided on right and left sides of the cleaner body 110. The caterpillar units 130 may be formed to be driven independently from each other. For instance, the caterpillar units 130 may be formed to be rotated in different directions at different speeds by the driving motors 134*a*. With such a configuration, the cleaner body 110 may be moved or rotated right and left and back and forth.

Further, the caterpillar unit 130 linearly-contact a floor in order to support the cleaner body 110, and is provided with a suspension 135 (refer to FIG. 7) in order to enhance a grip force. This will be explained later in more detail.

A moving performance of the autonomous cleaner 100 is determined by the castor 121, the caterpillar units 130 and the suspensions 135. However, as aforementioned in the above background of the disclosure, the structure disclosed in the patent documents has the following problems.

Firstly, once the castor is installed at the cleaner body, a moving resistance occurs by the castor. This may cause a moving performance of the autonomous cleaner 100 to be lowered. Secondly, if the caterpillar units linearly-contact a floor regardless of a state of the floor, the moving performance of the autonomous cleaner 100 is lowered in a situation where a high grip force is required. Thirdly, in a suspension structure having a swing arm 92 as shown in the patent document 2, a buffering effect cannot be uniformly obtained according to a driving direction due to the suspension design structure. This may cause the moving performance to be lowered in a specific situation. Hereinafter, a structure which has overcome the problems will be explained in more detail.

Figure 5:
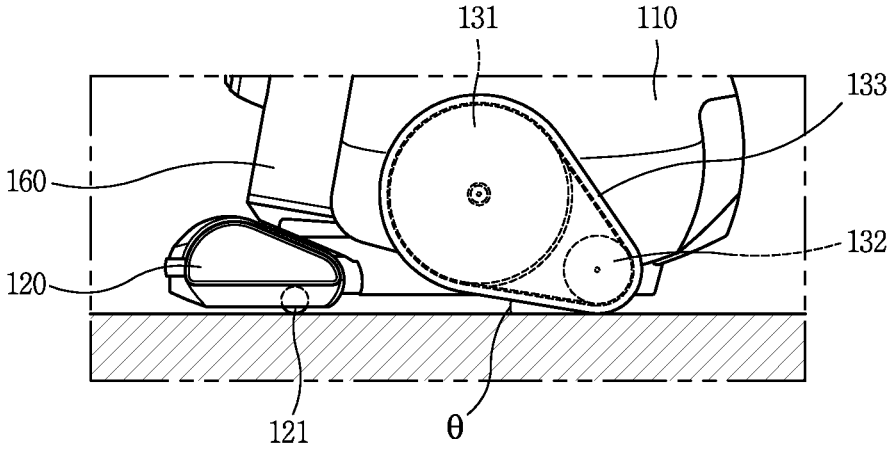
FIG. 5 is a conceptual view showing a state that the autonomous cleaner shown in FIG. 3 is positioned on a hard floor.
Figure 6:
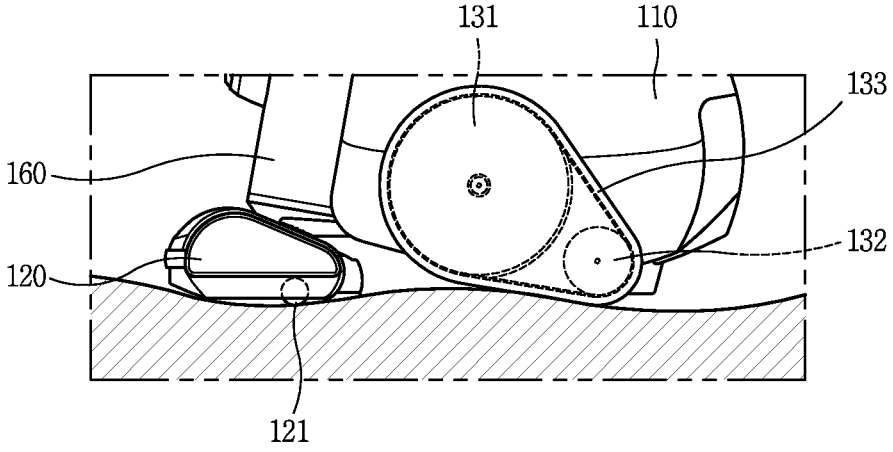
FIG. 6 is a conceptual view showing a state that the autonomous cleaner shown in FIG. 3 is positioned on a soft carpet.
Figure 7:
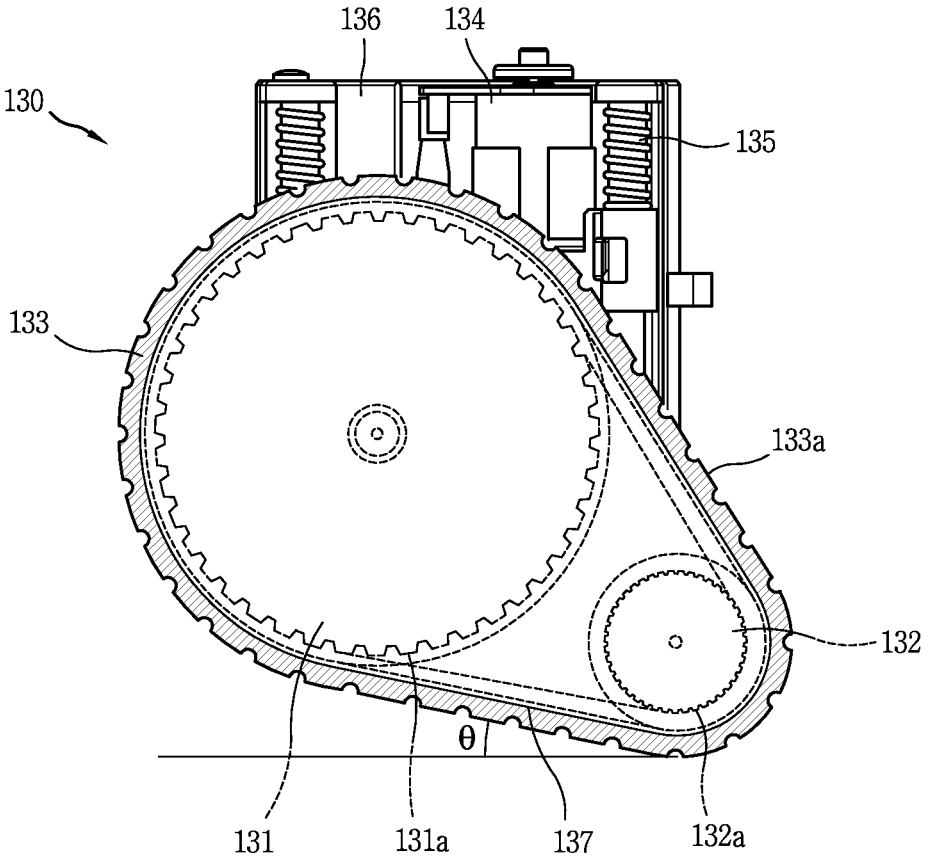
FIG. 7 is a frontal view of a caterpillar unit shown in FIG. 3.
Figure 8:
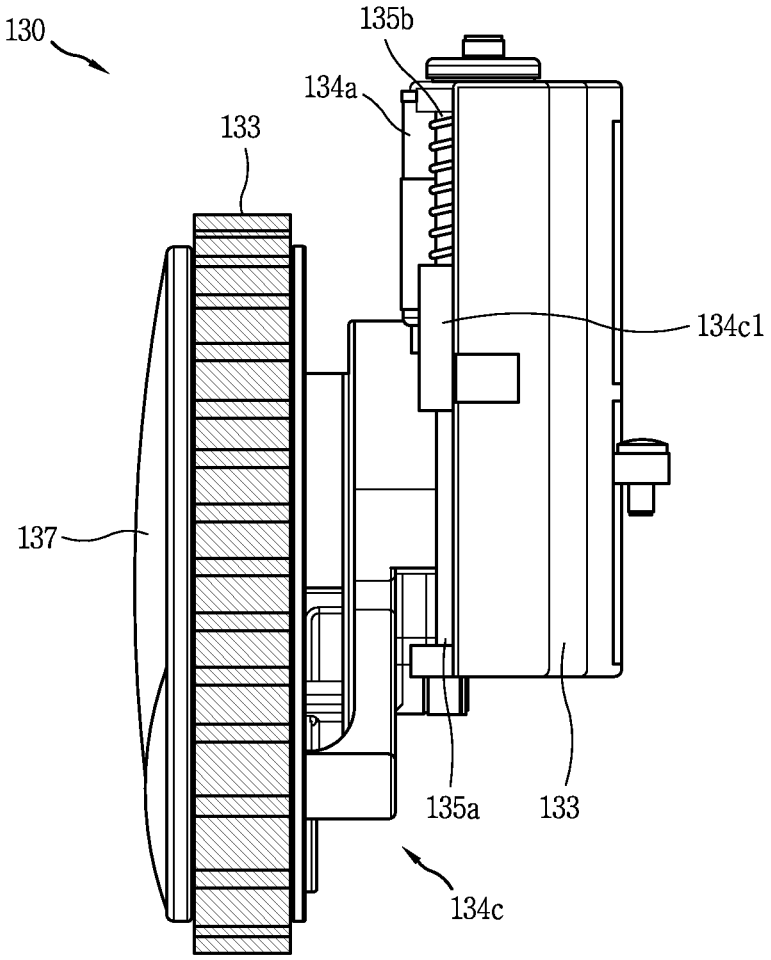
FIG. 8 is a lateral view of the caterpillar unit shown in FIG. 7.

FIG. 5 is a conceptual view showing a state that the autonomous cleaner 100 shown in FIG. 3 is positioned on a hard floor, and FIG. 6 is a conceptual view showing a state that the autonomous cleaner 100 shown in FIG. 3 is positioned on a soft carpet. FIGS. 7 and 8 are views of the caterpillar unit 130. For reference, FIGS. 7 and 8 show a shaded belt 133.

In the drawings, the caterpillar unit 130 includes a driving wheel 131 which supports and moves the autonomous cleaner 100, a driven wheel 132, the belt 133, driving devices (i.e., a driving module 134 and a housing 136), and the suspension 135 for protecting the cleaner body 110 from an external shock.

Firstly, the driving wheel 131, the driven wheel 132 and the belt 133 of the caterpillar unit 130 will be explained. The driving wheel 131 is rotatably mounted to the cleaner body 110, and is rotated by receiving a driving force from the driving module 134 to be explained later. More specifically, the driving wheels 131 are mounted to both sides of the cleaner body 110, and is configured to rotate the belt 133 clockwise or counterclockwise by rotation.

The driven wheel 132 is mounted to the cleaner body 110 in the same way as the driving wheel 131, and is arranged at a rear side of the driving wheel 131. The driven wheel 132 is engaged with the belt 133, and is rotated together with the belt 133 by a rotational force of the belt 133. The driven wheel 132 is configured to support the autonomous cleaner 100 together with the castor 121 provided at the cleaning module 120.

Concavo-convex portions 131*a*, 132*a* may be formed on outer circumferential surfaces of the driving wheel 131 and the driven wheel 132, in order to increase a frictional force with the belt 133. In the drawings, the concavo-convex portions 131*a*, 132*a* are formed on the outer circumferential surfaces of the driving wheel 131 and the driven wheel 132, in order to be engaged with a concavo-convex portion 133*b* formed on an inner circumferential surface of the belt 133 (refer to FIG. 9).

The caterpillar unit 130 may come in planar or linear-contact with a floor according to an arranged state of the driving wheel 131 and the driven wheel 132. With such a configuration, a structure to support the cleaner body 110, or a grip force of the caterpillar unit 130 may be changed.

In the drawings, the autonomous cleaner 100 is supported by the castor 121 and the driven wheel 132. More specifically, the driving wheel 131 is arranged at a front side of the driven wheel 132, and is spaced apart from a floor. Accordingly, the caterpillar unit 130 is configured to linearly contact a floor by the driven wheel 132.

The driving wheel 131 may be upward arranged to have a tilt angle (θ) with respect to the driven wheel 132. Here, the tilt angle (θ) may be more than 1° and less than 5°. If the tilt angle (θ) is within the range, the caterpillar unit 130 come in linear-contact with a hard floor, and come in planar-contact with a soft floor. This may allow a stable moving performance of the autonomous cleaner 100 to be obtained.

On the other hand, if the tilt angle (θ) is less than 1°, the caterpillar unit 130 may unintentionally come in planar-contact with a floor according to a state of the floor. For instance, if a floor has a rough surface, the caterpillar unit 130 may unintentionally come in planar-contact with the floor while moving. As another example, if the tilt angle (θ) exceeds 5°, the belt 133 of the caterpillar unit 130 may not come in planar-contact with a floor on a soft carpet.

Referring to FIGS. 5 to 7, the driving wheel 131 is arranged at a front side of the driven wheel 132, and is spaced apart from a floor by a distance corresponding to the tilt angle (θ). With such a configuration, since the caterpillar unit 130 comes in linear-contact with a hard floor (e.g., a bare floor or a papered floor), a high driving speed of the autonomous cleaner 100 may be obtained. On the other hand, in case of a soft floor requiring a high grip force (e.g., a carpet, a rug, etc.), the belt 133 comes in planar-contact with the floor. This may allow a stable moving performance of the autonomous cleaner 100 to be obtained.

In the drawings, a diameter of the driving wheel 131 provided at a front side of the cleaner body 110 is formed to be larger than that of the driven wheel 132. Generally, when a diameter of a wheel is large, an ascending performance of the autonomous cleaner 100 is enhanced because an ascending resistance to a moving direction is reduced. Accordingly, if the driving wheel 131 is larger than the driven wheel 132, the autonomous cleaner 100 has a higher ascending performance when moving forward than when moving backward.

However, the present disclosure is not limited to this. That is, the driving wheel 331 and the driven wheel 332 may have the same diameter such that the autonomous cleaner 100 may have the same ascending performance when moving forward and backward.

The belt 133 is formed to entirely enclose (or encircle) the driving wheel 131 and the driven wheel 132, thereby forming a closed loop. Once the driving wheel 131 is rotated by receiving a driving force from the driving module 134, the belt 133 interlocked with the driving wheel 131 is rotated together in a rotation direction of the driving wheel 131. In this case, the driven wheel 132 engaged with the belt 133 is also rotated as the belt 133 is rotated.

The belt 133 is integrally rotated with the driving wheel 131 and the driven wheel 132 to generate a frictional force with a floor, thereby allowing the autonomous cleaner 100 to move on a floor. The belt 133 is formed of an elastically transformable material (e.g., rubber, urethane, etc.). A concavo-convex portion 133*a* may be formed on an inner circumferential surface of the belt 133, in order to increase a frictional force with the driving wheel 131 and the driven wheel 132. Further, a concavo-convex portion 133*b* may be formed on an outer circumferential surface of the belt 133, in order to increase a frictional force with a floor. In an embodiment, the belt 133 may be formed as a timing belt.

An empty space where the belt 133 is elastically transformable towards the inside of the caterpillar unit 130 may be formed between the driving wheel 131 and the driven wheel 132. This is in order to provide an available space where the belt 133 is transformable by an obstacle while the autonomous cleaner 100 is ascending (climbing) the obstacle.

A wheel cover 137 may be provided to cover one side surface of the driving wheel 131 and the driven wheel 132, in order to protect the driving wheel 131 and the driven wheel 132 from an external environment. In the drawings, the wheel cover 137 covers not only an outer side surface of the driving wheel 131 and the driven wheel 132, but also an outer side surface of a space defined by the driving wheel 131, the driven wheel 132 and the belt 133. However, the present disclosure is not limited to this. That is, the wheel cover 137 may be configured to cover a part of one side surface of the driving wheel 131 and the driven wheel 132. With such a configuration, foreign materials may be prevented from being introduced into the caterpillar unit 130, and the driving wheel 131 and the driven wheel 132 may be protected from physical damage such as a scratch occurring while the autonomous cleaner 100 is moving.

Figure 9:
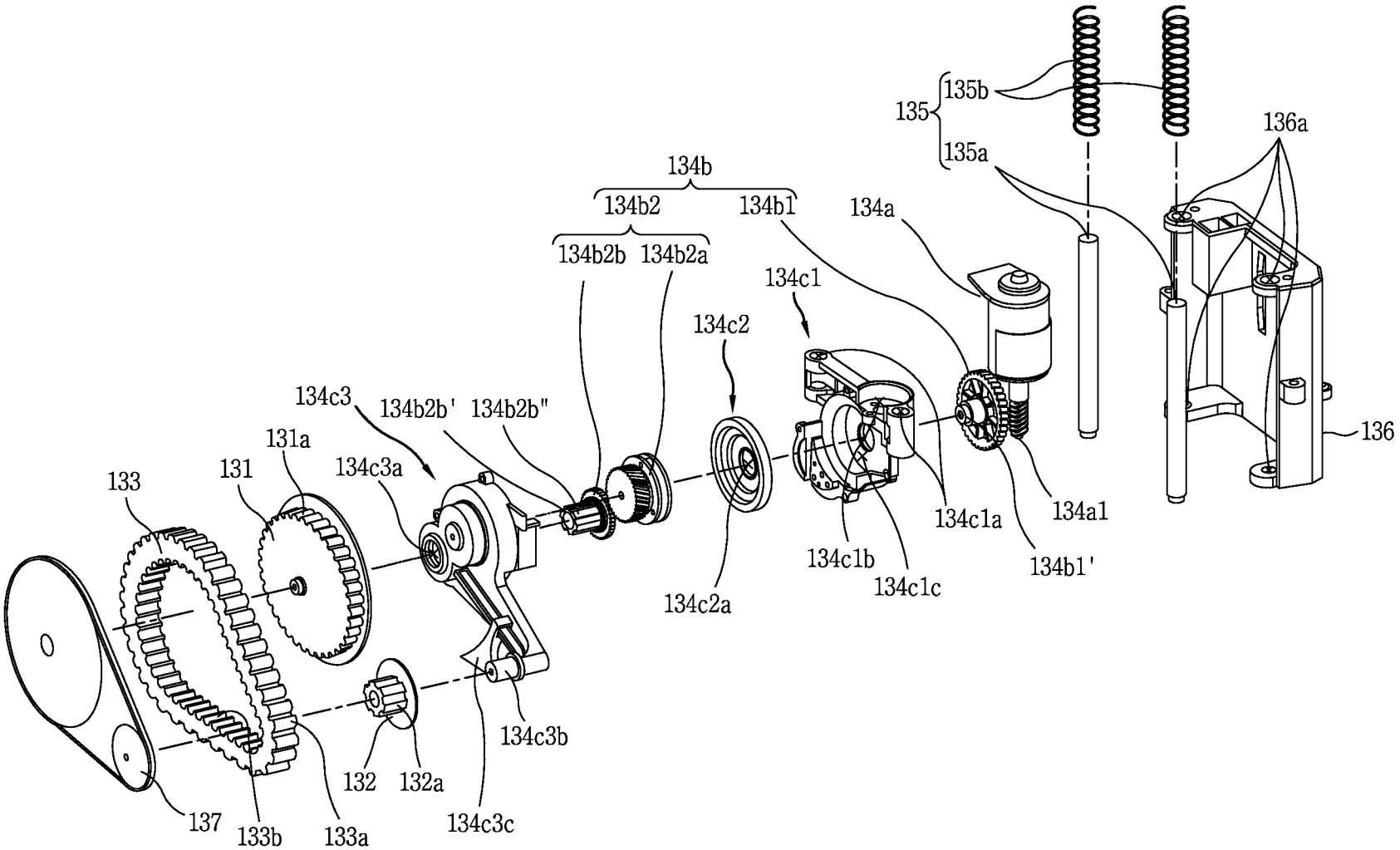
FIG. 9 is an exploded perspective view of the caterpillar unit shown in FIG. 7.
Figure 10:
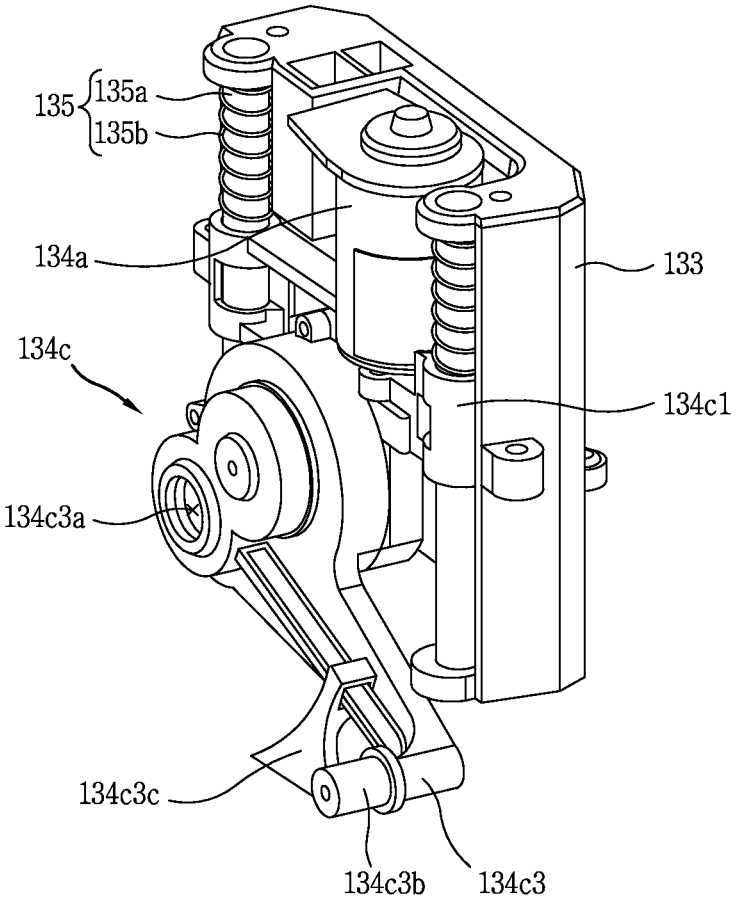
FIG. 10 is a view of the caterpillar unit shown in FIG. 9, which shows components except for wheel-related components.
Figure 11:
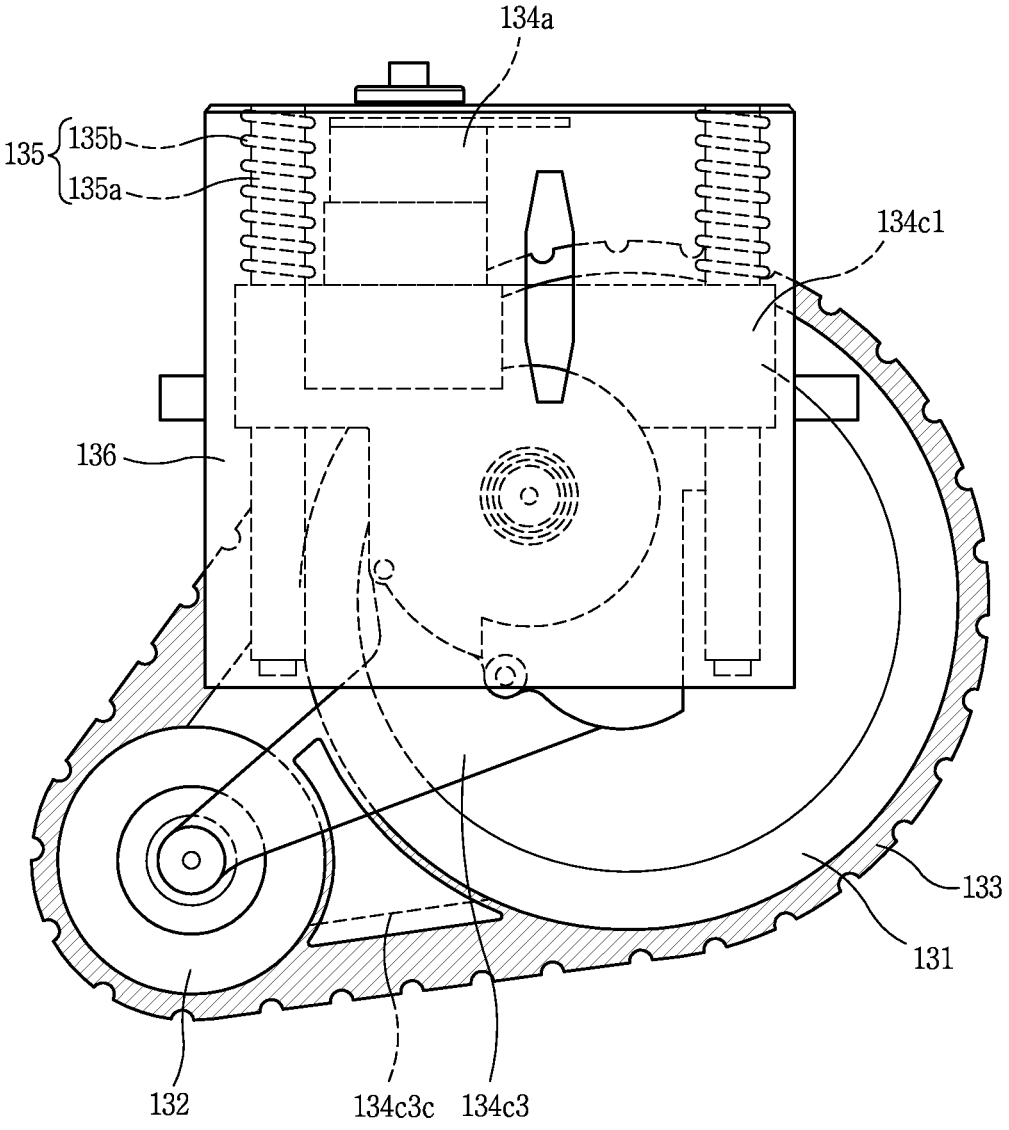
FIG. 11 is a rear view of the caterpillar unit shown in FIG. 7.

Next, the driving module 134 and the housing 136 of the caterpillar unit 130 will be explained. FIG. 9 is an exploded perspective view of the caterpillar unit 130 shown in FIG. 7. FIG. 10 is a view of the caterpillar unit 130 shown in FIG. 9, which shows components except for wheel-related components. And FIG. 11 is a rear view of the caterpillar unit 130 shown in FIG. 7.

In order to drive the autonomous cleaner 100, the driving module 134 is provided at the cleaner body 110, and is configured to generate a driving force and to transfer the driving force to the driving wheel 131. The driving module 134 includes a driving motor 134*a*, a gear unit (or gears or gear assembly) 134*b* and a gear box (or frame) 134*c*.

The driving motor 134*a* includes a driving part (not shown) for generating a driving force, and an encoder (not shown) for outputting information such as a rotation angle, a speed, etc. of the driving part (not shown) in the form of an electrical signal. The driving motor 134*a* is formed to be rotatable clockwise or counterclockwise, and the controller controls a driving (a rotation direction, a rotation angle, a rotation speed, etc.) of the driving motor 134*a* based on information obtained from the encoder.

The gear unit 134*b* is configured to transfer a driving force generated from the driving motor 134*a* to the driving wheel 131. More specifically, the gear unit 134*b* is formed of a plurality of gears. And the gear unit 134*b* is configured to change a rotation speed and a torque of the driving motor 134*a* through a control of a gear ratio, and to transfer the rotation speed and the torque to the driving wheel 131.

The gear box 134*c* forms an appearance of the driving module 134, and provides a space where components of the driving module 134 are fixedly arranged. The housing 136 to be explained later is connected to one side of the gear box 134*c*, and the driving wheel 131 and the driven wheel 132 are rotatably connected to another side of the gear box 134*c*. The connection will be explained later in more detail.

A foreign material introduction preventing unit (or gear cover extension) 134*c*3*c* for preventing introduction of foreign materials by covering at least part of a space defined by the driving wheel 131, the driven wheel 132 and the belt 133 may be protruded from the gear box 134*c*.

In the drawings, the foreign material introduction preventing unit 134*c*3*c* is arranged to cover a lower space defined by a lower part of the belt 133 which contacts the driving wheel 131, the driven wheel 132 and a bottom surface. However, the present disclosure is not limited to this. That is, the foreign material introduction preventing unit 134*c*3*c* may be arranged to cover an upper space defined by an upper part of the belt 133.

The housing 136 forms an accommodation space for accommodating therein the driving module 134 and the suspension 135 to be explained later, and is mounted to the cleaner body 110. Referring to the drawings, the housing 136 is formed to enclose one side of the driving module 134. And the housing 136 may be provided with through holes 136*a* at its upper and lower parts on both sides so as to insert guide bars 135*a* of the suspension 135 thereinto. A coupling relation between the gear box 134*c* and the gear unit 134*b* will be explained later.

Next, the suspension 135 of the caterpillar unit 130 will be explained. The suspension 135 is provided between the driving module 134 and the housing 136 such that an impact generated from the outside is not transferred to the cleaner body 110. More specifically, the suspension 135 guides the driving module 134 such that the driving module 134 moves up and down according to a state of a bottom surface, and attenuates an impact using an elastic member 135*b* to be explained later.

The suspension 135 includes guide bars 135*a* and elastic members 135*b*. The guide bars 135*a* provided at the housing 136 up and down are configured to guide an up-down movement of the driving module 134. More specifically, the guide bars 135*a* are inserted into guide holes 134*c*1*a* formed at both sides of the gear box 134*c*, and are mounted to through holes 136*a* formed at upper and lower parts of the housing 136 on both sides. With such a configuration, the driving module 134 is moveable up and down along the guide bars 135*a*. Further, at least one of the guide bars 135*a* and the housing 136 may be provided with a separation preventing structure for preventing the guide bars 135*a* provided at the housing 136 from being separated from the housing 136.

The elastic member 135*b* is provided between the driving module 134 and the cleaner body 110. And the elastic member 135*b* is configured to elastically support the driving module 134 which moves up and down, according to a state of a bottom surface, and to attenuate an impact applied to the autonomous cleaner 100. In the drawings, the elastic members 135*b* are formed to enclose the guide bars 135*a*, and are provided between the housing 136 and the driving module 134.

The elastic support means apply an elastic force to the driving module 134 by the elastic members 135*b*, in an opposite direction to a moving direction of the driving module 134, in a compressed or extended state of the elastic members 135*b* by the same distance as a moving distance of the driving module 134.

In the drawings, the elastic members 135*b* formed as coil springs are provided between the housing 136 and the driving module 134, with enclosing the guide bars 135*a*. However, the present disclosure is not limited to this. For instance, the elastic members 135*b* may be formed as plate springs. Under the above structure, a function of the suspension 135 may be uniformly performed regardless of a driving direction of the autonomous cleaner 100. Thus, a driving stability of the autonomous cleaner 100 may be enhanced.

Next, a structure of the gear unit 134*b* and the gear box 134*c* which constitute the driving module 134 will be explained in more detail. The gear unit 134*b* is formed of a plurality of gears, and transfers a driving force generated from the driving motor 134*a* to the driving wheel 131. The gear unit 134*b* includes a first gear portion (or first gear assembly) 134*b*1 and a second gear portion (or second gear assembly) 134*b*2.

The first gear portion 134*b*1 is rotated in an engaged state with a driving shaft 134*a*1 of the driving motor 134*a*. More specifically, a gear formed on an outer circumferential surface of the driving shaft 134*a*1 (e.g., a helical gear) is engaged with a gear of the first gear portion 134*b*1, thereby transferring a driving force of the driving motor 134*a* to the first gear portion 134*b*1.

The second gear portion 134*b*2 is rotated in an engaged state with the first gear portion 134*b*1 and the driving wheel 131. More specifically, the second gear portion 134*b*2 includes a first sub gear 134*b*2*a* and a second sub gear 134*b*2*b*. As the first and second sub gears 134*b*2*a*, 134*b*2*b* are sequentially rotated in an engaged state, a rotational force of the first gear portion 134b1 is transferred to the driving wheel 131. In an embodiment, the second gear portion 134b2 may be formed as a spur gear, a helical gear, and so on.

As aforementioned, the gear unit 134b may be protected from an external environment (e.g., dust) in an accommodated state in the gear box 134c. The gear box 134c includes a main case 134c1, a middle case 134c2 and a front case 134c3.

The main case 134c1 is provided with guide holes 134c1a for inserting the guide bars 135a. A driving motor accommodating portion 134c1b for accommodating the driving motor 134a therein is formed at an upper part of the main case 134c1. And a first gear accommodating portion 134c1c for accommodating the first gear portion 134b1 therein is formed on one side surface of the main case 134c1. In the drawings, the driving motor 134a is accommodated in the driving motor accommodating portion 134c1b, and the driving shaft 134a1 of the driving motor 134a is penetratingly-formed in an up and down direction of the main case 134c1.

The middle case 134c2 may be provided between the main case 134c1 and the front case 134c3. More specifically, one side of the middle case 134c2 may be provided to cover the first gear portion 134b1, and another side thereof may be provided to cover the second gear portion 134b2.

A first communication hole 134c2a is formed at the middle case 134c2. More specifically, as a rotation protrusion 134b1' of the first gear portion 134b1 passes through the first communication hole 134c2a, the first gear portion 134b1 is engaged with the first sub gear 134b2a of the second gear portion 134b2.

In the drawings, a space for accommodating the second gear portion 134b2 is formed on one surface of the front case 134c3. A second communication hole 134c3a for interlocking the second gear portion 134b2 with the driving wheel 131 through the front case 134c3, is formed at one side of another surface of the front case 134c3. And a boss 134c3b for rotatably mounting the driven wheel 132 is formed at another side thereof.

A protrusion portion 134b2b' is formed at the second sub gear 134b2b, and a coupling protrusion 134b2b" engaged with a coupling groove (not shown) of the driving wheel 131 is formed at the protrusion portion 134b2b'. As the protrusion portion 134b2b' passes through the second communication hole 134c3a of the front case 134c3, the coupling protrusion 134b2b" may be rotatably engaged with the coupling groove (not shown) of the driving wheel 131. And the boss 134c3b may be rotatably coupled to a coupling groove (not shown) of the driven wheel 132. The front case 134c3 may further include a foreign material introduction preventing unit 134c3c for preventing introduction of foreign materials by covering at least part of a space defined by the driving wheel 131, the driven wheel 132 and the belt 133.

Figure 12:
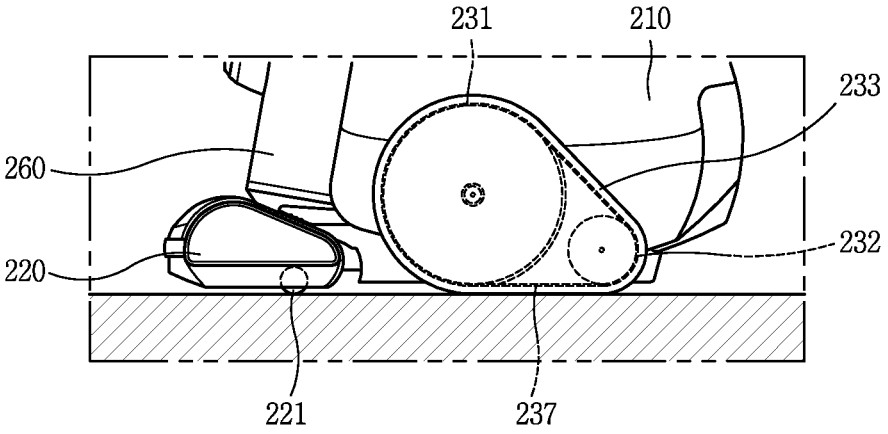
FIG. 12 is a view showing a second embodiment of the autonomous cleaner of FIG. 3, which illustrates a state that the autonomous cleaner is positioned on a hard floor.

FIG. 12 is a view showing a second embodiment of an autonomous cleaner 200 of FIG. 3, which illustrates a state that the autonomous cleaner 200 is positioned on a hard floor. Similar to the first embodiment, the autonomous cleaner 200 may include a cleaner body 210, a cleaning module 220, a castor 221, a dust container 260, etc. Explanations of the components will be replaced by those according to the first embodiment.

Referring to FIG. 12, a driving wheel 231 is configured to support the cleaner body 210 together with a driven wheel 232. More specifically, the driving wheel 231 is provided at a front side of the driven wheel 232, and the driving wheel 231 and the driven wheel 232 are supported on a floor surface. Thus, a caterpillar unit 230 comes in planar-contact with the floor surface. With such a configuration, the autonomous cleaner 200 may be stably supported by the caterpillar unit 230.

Moreover, even if the castor 221 is not provided at the cleaning module 220, the autonomous cleaner 200 may be stably supported by the caterpillar unit 230. Since the castor 221 needs not be provided at the cleaning module 220, a moving resistance occurring when the autonomous cleaner 200 moves due to the castor 221 can be reduced.

Figure 13:
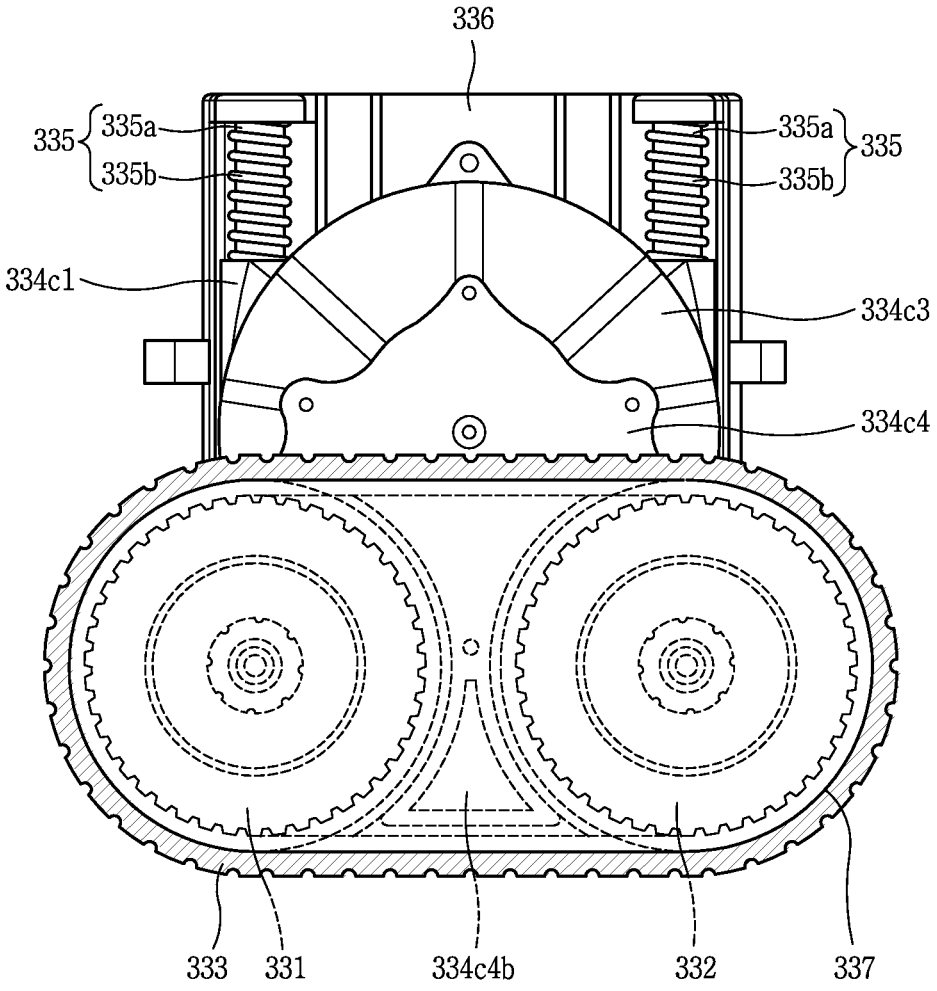
FIG. 13 is a view showing a third embodiment of the autonomous cleaner of FIG. 3, which is a frontal view of a caterpillar unit.
Figure 14:
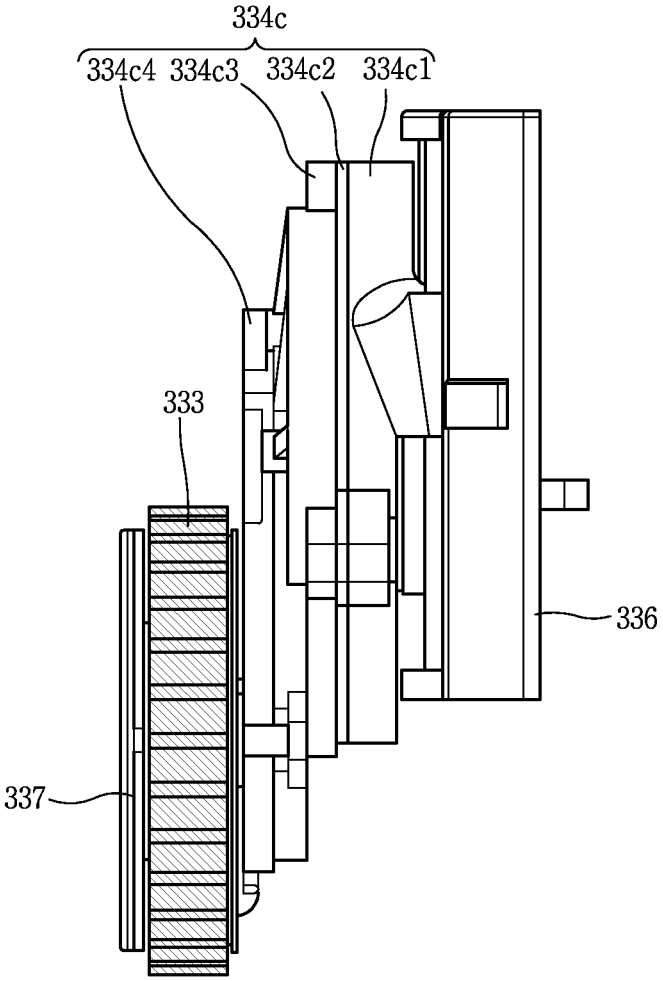
FIG. 14 is a lateral view of the caterpillar unit shown in FIG. 13.
Figure 15:
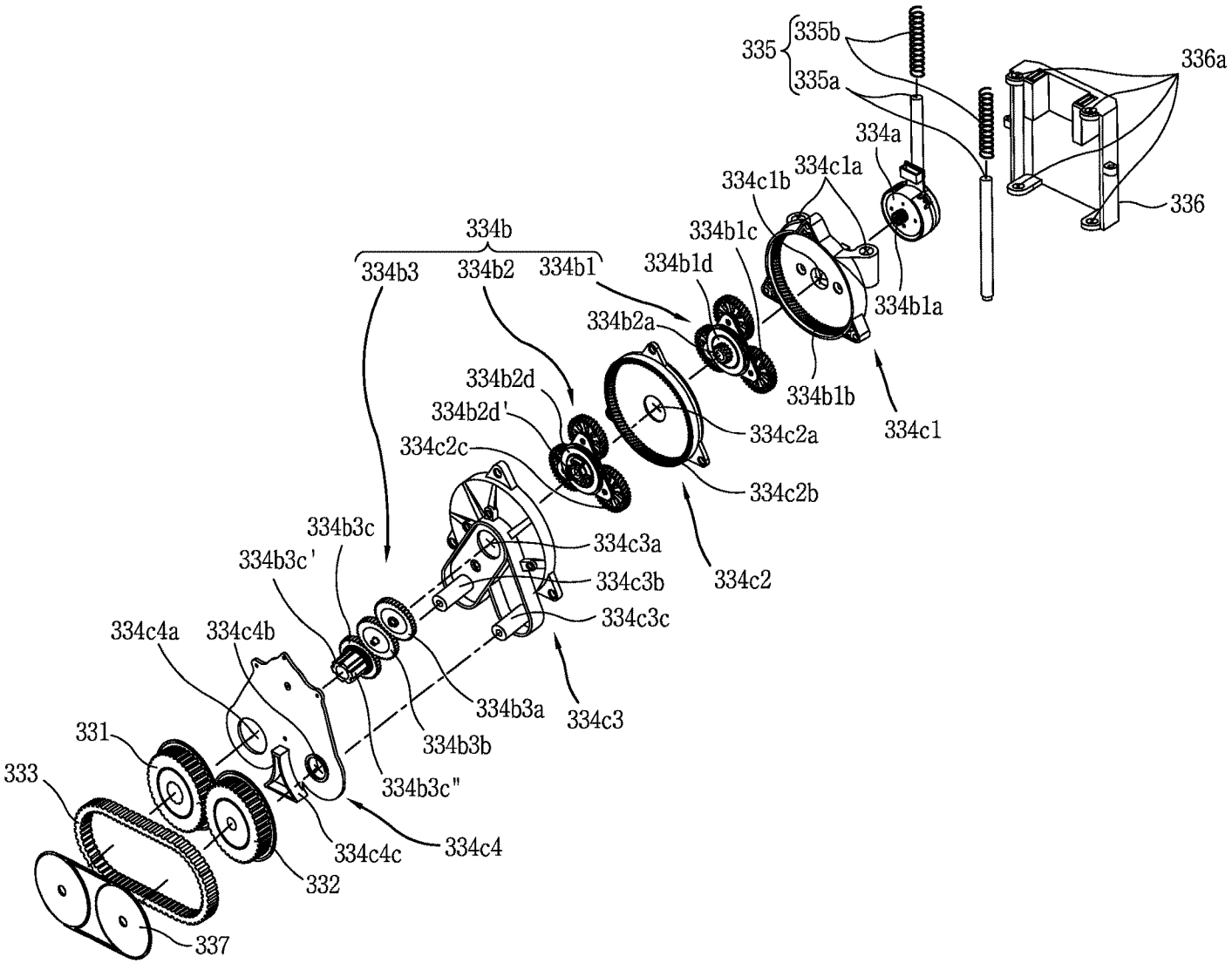
FIG. 15 is an exploded perspective view of the caterpillar unit shown in FIG. 13.
Figure 16:
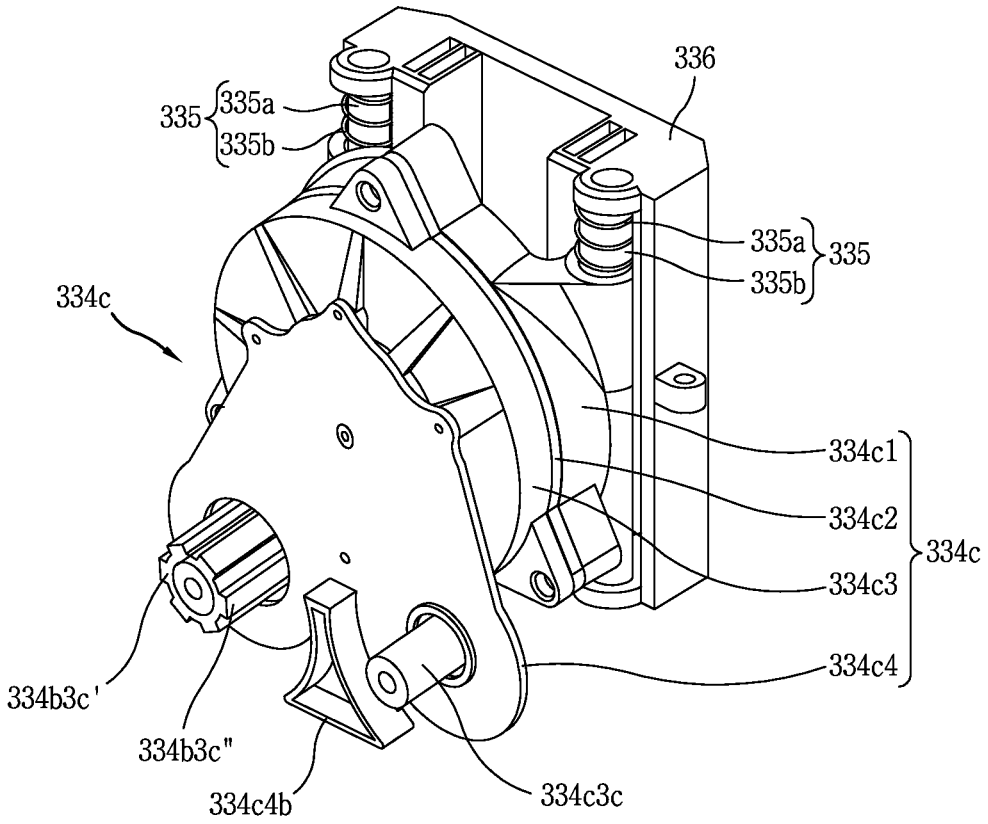
FIG. 16 is a view of the caterpillar unit shown in FIG. 13, which shows components except for wheel-related components.
Figure 17:
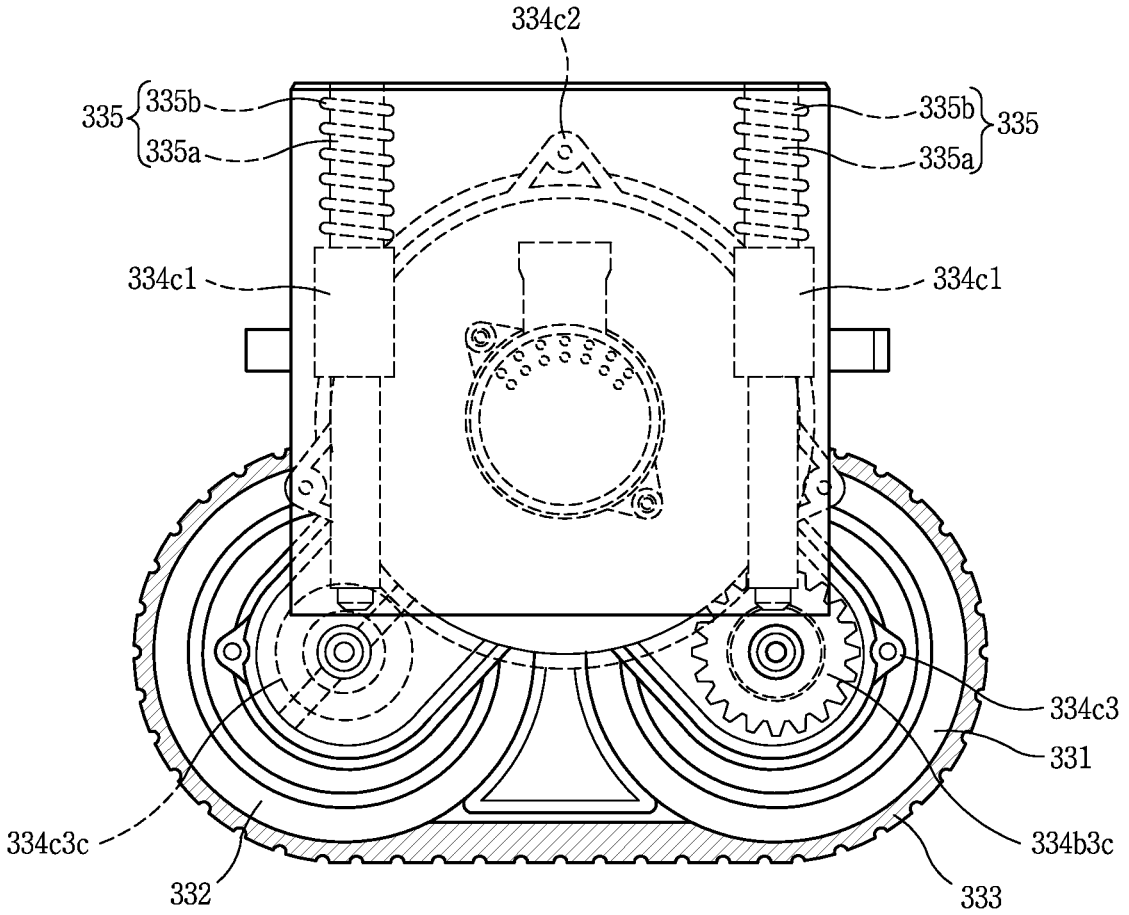
FIG. 17 is a rear view of the caterpillar unit shown in FIG. 13.

FIGS. 13 to 17 are views showing a third embodiment of the autonomous cleaner of FIG. 3, which show a gear unit 334b and a gear box 334c which constitute a driving module 334. FIG. 13 is a view showing a third embodiment of the autonomous cleaner of FIG. 3, which is a frontal view of a caterpillar unit. FIG. 14 is a lateral view of the caterpillar unit shown in FIG. 13. FIG. 15 is an exploded perspective view of the caterpillar unit shown in FIG. 13. FIG. 16 is a view of the caterpillar unit shown in FIG. 13, which shows components except for wheel-related components. And FIG. 17 is a rear view of the caterpillar unit shown in FIG. 13.

In the drawings, a caterpillar unit 330 comes in planar-contact with a floor surface, and a driving wheel 331 and a driven wheel 332 have the same diameter. However, similar to the first embodiment, as the driving wheel is upward inclined with respect to the driven wheel, a belt 333 of the caterpillar unit 330 may come in linear-contact with a floor surface. Further, similar to the second embodiment, as the driving wheel and the driven wheel are provided to support a floor surface, the belt 333 of the caterpillar unit 330 may come in planar-contact with the floor surface. Also, similar to the first and second embodiments, the driving wheel 331 may have a larger diameter than the driven wheel 332.

A gear unit (or gear assembly or gear train) 334b is formed of a plurality of gears, and transfers a driving force generated from a driving motor 334a to the driving wheel 331. More specifically, the gear unit 334b includes a first planet gear portion 334b1, a second planet gear portion 334b2, and a connection gear portion 334b3.

The first planet gear portion 334b1 is engaged with a sun gear to be explained later formed at a driving shaft of the driving motor 334a. The second planet gear portion 334b2 is interlocked with the first planet gear portion 334b1. The connection gear portion 334b3 is interlocked with each of the second planet gear portion 334b2 and the driving wheel 331.

The gear unit 334b is accommodated in a gear box 334c to be protected from an external environment (e.g., dust). The gear box 334c includes a main case 334c1, a middle case 334c2, a front case 334c3, and a gear cover 334c4.

The main case 334c1 is provided with guide holes 334c1a for passing guide bars 335a therethrough, at both sides thereof. The driving motor 334a is formed at one side of the main case 334c1, and the first planet gear portion 334b1 is accommodated in another side of the main case 334c1.

A first communication hole 334c1b is formed at the main case 334c1 such that the driving shaft of the driving motor 334a is interlocked with the first planet gear portion 334b1 through the main case 334c1. That is, the driving shaft of the driving motor 334a is connected to the first planet gear portion 334b1 through the first communication hole 334c1b. Thus, a driving force provided from the driving motor 334a is transferred to the first planet gear portion 334b1.

The first planet gear portion 334b1 includes a first sun gear 334b1a, a first ring gear 334b1b, a plurality of first planet gears 334b1c, and a first cage 334b1d. The first sun gear 334*b*1*a* is coupled to the driving shaft of the driving motor 334*a*, and is exposed to another side of the main case 334*c*1 through the first communication hole 334*c*1*b*. The first sun gear 334*b*1*a* may be formed to be rotatable in two directions according to a driving signal applied from the controller.

The first ring gear 334*b*1*b* is formed to enclose the first sun gear 334*b*1*a* at another side of the main case 334*c*1. The first sun gear 334*b*1*a* is provided at the center of the first ring gear 334*b*1*b*. As shown, the first ring gear 334*b*1*b* may be formed at the main case 334*c*1.

The plurality of first planet gears 334*b*1*c* are formed to rotate on their axes and to revolve around the first sun gear 334*b*1*a*, in an engaged state to the first sun gear 334*b*1*a* and the first ring gear 334*b*1*b*. In the above structure where the first ring gear 334*b*1*b* is fixed, a rotation direction of the plurality of first planet gears 334*b*1*c* is opposite to a rotation direction of the first sun gear 334*b*1*a*, and a revolving direction of the plurality of first planet gears 334*b*1*c* is the same as the rotation direction of the first sun gear 334*b*1*a*.

The first cage 334*b*1*d* rotatably supports a rotation axis of each of the plurality of first planet gears 334*b*1*c*. The first cage 334*b*1*d* is provided to cover a part of each of the plurality of first planet gears 334*b*1*c*. The first cage may be provided to cover the first sun gear 334*b*1*a*. In this case, the first cage may be configured to rotatably support a rotation shaft of the first sun gear 334*b*1*a*.

The middle case 334*c*2 is coupled to the main case 334*c*1. One side of the middle case 334*c*2 is provided to cover the first planet gear portion 334*b*1, and another side of the middle case 334*c*2 is formed to accommodate therein the second planet gear portion 334*b*2. A second communication hole 334*c*2*a* for interlock of the first and second planet gear portions 334*b*1, 334*b*2 is formed at the middle case 334*c*2.

The second planet gear portion 334*b*2 includes a second sun gear 334*b*2*a*, a second ring gear 334*b*2*b*, a plurality of second planet gears 334*b*2*c*, and a second cage 334*b*2*d*. The second sun gear 334*b*2*a* is protruded from the first cage 334*b*1*d*, and is exposed to another side of the middle case 334*c*2 through the second communication hole 334*c*2*a*.

The second ring gear 334*b*2*b* is formed to enclose the second sun gear 334*b*2*a* at another side of the middle case 334*c*2. The second sun gear 334*b*2*a* is provided at the center of the second ring gear 334*b*2*b*. As shown, the second ring gear 334*b*2*b* may be formed at the middle case 334*c*2.

The plurality of second planet gears 334*b*2*c* are formed to rotate on their axes and to revolve around the second sun gear 334*b*2*a*, in an engaged state to the second sun gear 334*b*2*a* and the second ring gear 334*b*2*b*. In the above structure where the second ring gear 334*b*2*b* is fixed, a rotation direction of the plurality of second planet gears 334*b*2*c* is opposite to a rotation direction of the second sun gear 334*b*2*a*, and a revolving direction of the plurality of second planet gears 334*b*2*c* is the same as the rotation direction of the second sun gear 334*b*2*a*.

The second cage 334*b*2*d* rotatably supports a rotation axis of each of the plurality of second planet gears 334*b*2*c*. The second cage 334*b*2*d* is provided to cover a part of each of the plurality of second planet gears 334*b*2*c*. The second cage 334*b*2*d* may be provided to cover the second sun gear 334*b*2*a*. In this case, the second cage may be configured to rotatably support a rotation shaft of the second sun gear 334*b*2*a*.

The front case 334*c*3 is coupled to the main case 334*c*1 and the middle case 334*c*2 at the housing outside the gear box 334*c*. The second planet gear portion 334*b*2 is accommodated into one side of the front case 334*c*3, and the connection gear portion 334*b*3 is accommodated into another side thereof. A third communication hole 334*c*3*a* for interlock of the second planet gear portion 334*b*2 with the connection gear portion 334*b*3 is formed at the front case 334*c*3.

The connection gear portion 334*b*3 includes a first connection gear 334*b*3*a*, a second connection gear 334*b*3*b*, and a third connection gear 334*b*3*c*. The first to third connection gears 334*b*3*a*, 334*b*3*b*, 334*b*3*c* are configured to transfer a rotational force of the second planet gear portion 334*b*2 to the driving wheel 331, in a sequentially engaged state to each other. For instance, the connection gear portion 334*b*3 may be formed as a spur gear, a helical gear, and so on.

A protrusion inserted into the third communication hole 334*c*3*a* is formed at the second cage 334*b*2*d*. And the protrusion is exposed to another side of the front case 334*c*3 through a coupling protrusion engaged with a coupling groove (not shown) of the first connection gear 334*b*3*a*. First and second boss 334*c*3*b*, 334*c*3*c* are formed at the front case 334*c*3 towards the outside of a cleaner body 310, such that the driving wheel 331 and the driven wheel 332 are rotatably coupled thereto.

The gear cover 334*c*4 is coupled to the front case 334*c*3 to cover the connection gear portion 334*b*3. And the gear cover 334*c*4 is provided with a fourth communication hole 334*c*4*a* and a fifth communication hole 334*c*4*b*, in correspondence to the first and second boss 334*c*3*b*, 334*c*3*c*.

The third connection gear 334*b*3*c* is rotatably coupled to a first boss 334*c*3*b*. A protrusion 334*b*3*c*' is formed at the third connection gear 334*b*3*c*. And a coupling protrusion 334*b*3*c*" engaged with a coupling groove (not shown) of the driving wheel 331 is formed at the protrusion 334*b*3*c*', so as to be exposed to another side of a first cover 334*c*4 through the fourth communication hole 334*c*4*a*. Further, the second boss 334*c*3*c* is exposed to another side of the fifth communication hole 334*c*4*b*, in order to be interlocked with the driven wheel 332.

A foreign material introduction preventing unit 334*c*4*c* for preventing introduction of foreign materials by covering at least part of a space defined by the driving wheel 331, the driven wheel 332 and the belt 333 may be protruded from the gear cover 334*c*4. In the drawings, the foreign material introduction preventing unit 334*c*4*c* is arranged to cover a lower space defined by a lower part of the belt 333 which contacts the driving wheel 331, the driven wheel 332 and a bottom surface. However, the present disclosure is not limited to this. That is, the foreign material introduction preventing unit 334*c*4*c* may be arranged to cover up to an upper space defined by an upper part of the belt 333, i.e., to cover an entire space.

With such a configuration of the gear unit 334*b* and the gear box 334*c*, a driving force formed as a rotation speed and a torque of the driving motor 334*a* are properly changed is transferred to the driving wheel 331. And a malfunction of the gear unit 334*b* may be prevented by the foreign material introduction preventing unit 334*c*4*c*.

Therefore, a first aspect of the detailed description is to provide an autonomous cleaner having a novel structure capable of maintaining a driving stability and capable of reducing a moving resistance, without the conventional castor provided at a cleaner body in order to support the cleaner body together with caterpillars. A second aspect of the detailed description is to provide an autonomous cleaner capable of controlling a grip force in correspondence to a characteristic of a floor on which the autonomous cleaner is moving. A third aspect of the detailed description is to provide an autonomous cleaner capable of performing the same suspension function regardless of a moving direction.

To achieve these and other advantages and in accordance with the purpose of this specification, as embodied and broadly described herein, there is provided an autonomous cleaner, comprising: a cleaner body; caterpillar units provided at both sides of the cleaner body, and positioned at a rear side of a cleaning module, wherein the caterpillar unit includes: a driving module; a driving wheel mounted to the driving module, and formed to be rotatable by receiving a driving force from the driving module; a driven wheel mounted to the driving module, and provided at a rear side of the driving wheel; and a belt formed to entirely enclose the driving wheel and the driven wheel as a closed loop, and configured to rotate the driven wheel when the driving wheel is rotated.

In order to achieve the first purpose of the present disclosure, the autonomous cleaner further comprises a cleaning module protruded from one side of the cleaner body, and having a castor. And the cleaner body is supported on a floor surface by the castor and the driven wheel.

The first purpose of the present disclosure may be achieved by a configuration that the cleaner body is supported on a floor surface by the driving wheel and the driven wheel. With the configuration, the cleaner body may be provided with no castor.

The second purpose of the present disclosure may be achieved by a configuration that the driving wheel is provided at a front upper side of the driven wheel, in a state that the cleaner body is supported on a floor surface. The driving wheel may be provided to be higher than the driven wheel by 1°~5°.

In order to achieve the second purpose of the present disclosure, the caterpillar unit may further include: a housing mounted to the cleaner body, and configured to accommodate the driving module therein; and a suspension formed to be moveable up and down in the housing, configured to guide an up-down movement of the driving module, and configured to absorb an impact when the driving module moves up and down.

In order to achieve the third purpose of the present disclosure, the caterpillar unit may further include: a housing mounted to the cleaner body, and configured to accommodate the driving module therein; and a suspension formed to be moveable up and down in the housing, configured to guide an up-down movement of the driving module, and configured to absorb an impact when the driving module moves up and down.

The suspension may include: guide bars provided in the housing up and down, formed to penetrate the driving module, and configured to guide an up-down movement of the driving module; and an elastic member formed to enclose the guide bars, provided between the housing and the driving module, and configured to absorb an impact when the driving module moves up and down.

The above disclosure may be configured as follows. The driving module may include: a driving motor; a gear unit configured to transfer a rotational force of the driving motor to the driving wheel, after decelerating the driving motor; and a gear box configured to provide a space where the driving motor is mounted, configured to accommodate the gear unit therein, and formed to be moveable up and down in the housing.

A foreign material introduction preventing unit for covering at least part of a space defined by the driving wheel, the driven wheel and the belt may be protruded from the gear box. The driving wheel may have a larger diameter than the driven wheel such that an ascending resistance may become smaller when the autonomous cleaner moves forward than when the autonomous cleaner moves backward. The driving wheel and the driven wheel may have the same diameter such that the autonomous cleaner may have the same ascending performance when moving forward and backward.

The present disclosure may have the following advantages. Firstly, the cleaner body is supported on a floor surface by the castor and the driven wheel, or is supported on a floor surface by the driving wheel and the driven wheel of the caterpillar unit. Accordingly, the conventional castor for stably supporting the cleaner body is not required. Since such a castor serving as a moving resistance when the autonomous cleaner moves on a soft carpet or ascends an obstacle is not installed, a moving performance of the autonomous cleaner may be enhanced.

Secondly, in case of a hard floor (e.g., a bare floor or a papered floor), the cleaner body is supported by the castor of the cleaning module protruded from one side of the cleaner body, and the driven wheel of the caterpillar unit provided at a rear side of the cleaning module. In this case, the driving wheel is provided at a front upper side of the driven wheel, in a spaced state from the floor. On the other hand, in case of a soft floor such as a carpet, even the driving wheel is configured to contact the carpet.

Under the above structure, in a general driving situation (e.g., in case of a hard floor), only the driven wheel of the caterpillar unit comes in linear-contact with the floor, a moving resistance may be reduced. On the other hand, in a situation requiring a high grip force (e.g., in case of a soft floor), even the driving wheel contacts the floor for the same effect as a planar contact. This may enhance a moving performance.

Further, the driving module having the driving wheel and the driven wheel is formed to be moveable up and down, and the suspension is configured to absorb an impact with maintaining a grip force with a floor surface, when the driving module moves up and down. This may allow the grip force to be controlled in correspondence to a characteristic of the floor.

Thirdly, the driving module having the driving wheel and the driven wheel is formed to be moveable up and down along the guide bars, and the elastic member is configured to absorb an impact when the driving module moves up and down. This may allow a ground contact function and an impact attenuation function to be uniformly performed regardless of a moving direction.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An autonomous cleaner, comprising:
a cleaner body;
a cleaning head coupled to front surface of the cleaner body;
continuous tracks provided at sides of the cleaner body, and positioned rearward relative to the cleaning head,
wherein each of the continuous tracks includes:
a frame;
a driving wheel mounted to the frame and formed to be rotatable based on receiving a driving force from a motor;
a driven wheel mounted to the frame and provided rearward of the driving wheel; and
a belt configured to form a closed loop around outer circumferential surfaces of the driving wheel and the driven wheel, and to rotate the driven wheel when the driving wheel is rotated by the motor,
wherein the cleaner body is supported on a floor surface a portion of belt adjacent to the driven wheel and not by another portion of the belt adjacent to the driving wheel, and
wherein each of the continuous tracks further includes:
a housing mounted to the cleaner body and configured to accommodate the motor therein; and
a suspension formed to be moveable vertically in the housing, and configured to guide a vertical movement of the motor, and to absorb an impact when the motor moves vertically.

2. The autonomous cleaner of claim 1, wherein another wheel is mounted on the cleaning head, and wherein the cleaner body is further supported on the floor surface by the wheel mounted on the cleaning head.

3. The autonomous cleaner of claim 1, wherein the driving wheel is provided higher than and closer to the cleaner head than the driven wheel when the body is supported on the floor surface by the portion of belt adjacent to the driven wheel.

4. The autonomous cleaner of claim 3, wherein the driving wheel is provided to be higher than the driven wheel by 1°~5°.

5. The autonomous cleaner of claim 1, wherein the suspension includes:
one or more guide bars provided vertically in the housing, and configured to guide the vertical movement of the motor; and
a spring provided between the housing and the motor, and configured to absorb the impact when the motor moves vertically.

6. The autonomous cleaner of claim 1, wherein each of the continuous tracks further includes:
gears configured to transfer the driving force of the motor to the driving wheel, and
wherein the frame is configured to provide a space where the motor is mounted, is configured to accommodate the gear therein, and is formed to be moveable vertically in the housing.

7. The autonomous cleaner of claim 6, further comprising a gear cover extension extending from the frame and configured to cover at least part of a space defined by the driving wheel, the driven wheel and the belt.

8. The autonomous cleaner of claim 1, wherein the driving wheel has a larger diameter than the driven wheel such that an ascending resistance becomes smaller when the autonomous cleaner moves forward than when the autonomous cleaner moves backward.

9. An autonomous cleaner, comprising:
a cleaner body; and
continuous tracks provided at sides of the cleaner body,
wherein each of the continuous tracks includes:
a frame;
a driving wheel mounted to the frame and formed to be rotatable based on receiving a driving force from a motor;
a driven wheel mounted to the frame and provided rearward of the driving wheel; and
a belt configured to form a closed loop around outer circumferential surfaces of the driving wheel and the driven wheel, and to rotate the driven wheel when the driving wheel is rotated by the driving force of the motor, and
wherein the cleaner body is supported on a floor surface by portions of the belt contacting the driving wheel and the driven wheel, and
wherein each of the continuous tracks further includes:
a housing mounted to the cleaner body and configured to accommodate the motor therein; and
a suspension formed to be moveable vertically in the housing, and configured to guide a vertical movement of the motor and to absorb an impact when the motor moves vertically.

10. The autonomous cleaner of claim 9, further comprising a cleaning head coupled to a front portion of the cleaner body, and no wheel is provided between the cleaning head and the floor surface.

11. The autonomous cleaner of claim 9, wherein the suspension includes:
guide bars provided vertically in the housing, and configured to guide the vertical movement of the motor; and
an elastic spring provided between the housing and the motor, and configured to absorb the impact when the motor moves vertically.

12. The autonomous cleaner of claim 11, wherein each of the continuous tracks further includes:
gears configured to transfer the driving force of the motor to the driving wheel, and
wherein the frame is configured to provide a space where the motor, is configured to accommodate the gears therein, and is formed to be moveable vertically in the housing.

13. The autonomous cleaner of claim 12, further comprising a gear cover extension that is configured to cover at least part of a space defined by the driving wheel, the driven wheel and the belt.

14. The autonomous cleaner of claim 9, wherein a diameter of the driving wheel is larger than a diameter of the driven wheel such that an ascending resistance of the autonomous cleaner when becomes smaller when the autonomous cleaner moves forward than when the autonomous cleaner moves backward.

15. The autonomous cleaner of claim 9, wherein the driving wheel and the driven wheel have a same diameter such that an ascending performance of the autonomous cleaner does not change when the autonomous cleaner is moving forward or backward.

16. An autonomous cleaner, comprising:

a cleaner body; and continuous tracks provided at sides of the cleaner body, wherein each of the continuous tracks includes:

a housing mounted to the cleaner body;

a frame, motor, and gears accommodated in the housing and configured to be moveable vertically;

a suspension configured to guide a vertical movement of the motor, and to absorb an impact associated with the vertical movement of the motor;

a driving wheel formed to be rotatable based on receiving a driving force from the motor via the gears;

a driven wheel mounted to the frame and provided rearward relative to the driving wheel; and a belt configured to formed a closed loop around outer circumferential surfaces of the driving wheel and the driven wheel, and to rotate the driven wheel when the driving wheel is rotated by the driving force of the motor.

17. The autonomous cleaner of claim 16, wherein the suspension includes:

guide bars vertically provided in the housing, and configured to guide the vertical movement of the motor; and an elastic spring formed to enclose the guide bars, provided between the housing and the motor, and configured to absorb the impact associated with the vertical movement of the motor.

18. The autonomous cleaner of claim 16, further comprising a gear cover extension that is configured to cover at least part of a space defined by the driving wheel, the driven wheel and the belt.

19. The autonomous cleaner of claim 16, wherein a diameter of the driving wheel is larger than a diameter of the driven wheel such that an ascending resistance of the autonomous cleaner when becomes smaller when the autonomous cleaner moves forward than when the autonomous cleaner moves backward.

20. The autonomous cleaner of claim 16, wherein the driving wheel and the driven wheel have a same diameter such that an ascending performance of the autonomous cleaner does not change when the autonomous cleaner is moving forward or backward.

* * * * *